US010677415B1

(12) United States Patent
Zhao

(10) Patent No.: US 10,677,415 B1
(45) Date of Patent: Jun. 9, 2020

(54) OPTICAL SYSTEM

(71) Applicant: Amerlux LLC, Oakland, NJ (US)

(72) Inventor: Feng Zhao, Oakland, NJ (US)

(73) Assignee: AMERLUX LLC, Oakland, NJ (US)

( * ) Notice: Subject to any disclaimer, the term of this patent is extended or adjusted under 35 U.S.C. 154(b) by 86 days.

(21) Appl. No.: 15/683,427

(22) Filed: Aug. 22, 2017

Related U.S. Application Data

(63) Continuation of application No. PCT/US2015/054332, filed on Oct. 6, 2015, which is a continuation-in-part of application No. 14/709,618, filed on May 12, 2015, now Pat. No. 9,759,402.

(60) Provisional application No. 62/137,059, filed on Mar. 23, 2015, provisional application No. 62/060,448, filed on Oct. 6, 2014.

(51) Int. Cl.

| | |
|---|---|
| ***F21V 5/00*** | (2018.01) |
| ***F21V 5/04*** | (2006.01) |
| ***F21V 17/00*** | (2006.01) |
| ***F21K 9/233*** | (2016.01) |
| ***F21V 7/00*** | (2006.01) |
| *F21Y 115/10* | (2016.01) |

(52) U.S. Cl.
CPC ..... *F21V 5/008* (2013.01); *F21K 9/233* (2016.08); *F21V 5/002* (2013.01); *F21V 5/045* (2013.01); *F21V 7/0091* (2013.01); *F21V 17/002* (2013.01); *F21Y 2115/10* (2016.08)

(58) Field of Classification Search
CPC ..... F21V 5/002; F21V 5/045; F21V 7/0091; F21V 17/002; F21V 5/008; F21K 9/233
See application file for complete search history.

(56) References Cited

U.S. PATENT DOCUMENTS

| | | | |
|---|---|---|---|
| 4,698,730 | A | 10/1987 | Sakai et al. |
| 5,130,531 | A | 7/1992 | Ito et al. |
| 5,803,579 | A | 9/1998 | Turnbull et al. |
| 7,349,163 | B2 | 3/2008 | Angelini et al. |
| 7,431,480 | B2 | 10/2008 | Godo |
| 7,465,075 | B2 | 12/2008 | Chinniah et al. |

(Continued)

FOREIGN PATENT DOCUMENTS

| | | | |
|---|---|---|---|
| CN | 102537843 | A | 7/2012 |

OTHER PUBLICATIONS

International Search Report and the Written Opinion of the International Searching Authority issued in corresponding international application No. PCT/US2015/054332, dated Feb. 18, 2016.

(Continued)

*Primary Examiner* — Jong-Suk (James) Lee
*Assistant Examiner* — Christopher E Dunay
(74) *Attorney, Agent, or Firm* — Day Pitney LLP

(57) ABSTRACT

The present disclosure provides an optical system including a TIR mother lens and a secondary output lens, preferably for efficiently distributing light out of an LED track lighting system. The optical system of the present disclosure is configured to create variant beam angles from a lens assembly using the same TIR lens. Preferably, by altering the dimensions and focal lengths of the secondary output lens in a single TIR lens, the optical system can create a variety of beam angles, including, but not limited to, Spot ("SP"), Narrow Flood ("NFL"), Flood ("FL"), or Wide Flood ("WFL") beam angles.

13 Claims, 18 Drawing Sheets

(56) References Cited

U.S. PATENT DOCUMENTS

| | | | | |
|---|---|---|---|---|
| 8,283,844 | B2 | 10/2012 | Cho et al. | |
| 8,641,230 | B1 * | 2/2014 | Jiang | F21V 5/004 264/1.7 |
| 8,979,320 | B1 | 3/2015 | McDermott | |
| 9,109,775 | B2 | 8/2015 | Burt et al. | |
| 2005/0201118 | A1 | 9/2005 | Godo | |
| 2007/0019416 | A1 | 1/2007 | Han et al. | |
| 2008/0310028 | A1 | 12/2008 | Chinniah et al. | |
| 2009/0213469 | A1 | 8/2009 | Braune et al. | |
| 2009/0279296 | A1 | 11/2009 | Chang | |
| 2010/0091499 | A1 | 4/2010 | Jiang | |
| 2011/0149581 | A1 | 6/2011 | Jiang | |
| 2011/0267823 | A1 * | 11/2011 | Angelini | F21L 4/027 362/277 |
| 2012/0099328 | A1 | 4/2012 | Miyashita et al. | |
| 2012/0230057 | A1 | 9/2012 | Braden | |
| 2012/0250330 | A1 * | 10/2012 | Kelly | B29D 11/00596 362/308 |
| 2013/0042510 | A1 * | 2/2013 | Nall | F21V 5/04 40/541 |
| 2013/0077320 | A1 * | 3/2013 | Duan | F21V 5/045 362/297 |
| 2013/0265755 | A1 | 10/2013 | Adams | |
| 2013/0293148 | A1 * | 11/2013 | Holland | F21V 5/04 315/297 |
| 2014/0049939 | A1 | 2/2014 | Kuenzler et al. | |
| 2014/0091697 | A1 | 4/2014 | Shum | |
| 2014/0204587 | A1 * | 7/2014 | Hukkanen | G02B 3/08 362/308 |
| 2015/0003074 | A1 * | 1/2015 | Calvin | F21V 13/04 362/297 |
| 2015/0062917 | A1 | 3/2015 | Yin | |
| 2015/0184832 | A1 | 7/2015 | Dai et al. | |
| 2015/0192257 | A1 | 7/2015 | Javadian et al. | |
| 2018/0058666 | A1 * | 3/2018 | Huang | F21V 14/06 |

OTHER PUBLICATIONS

USPTO's Non-Final Office Action in related U.S. Appl. No. 14/709,618, dated Aug. 28, 2015.

USPTO's Final Office Action issued in related U.S. Appl. No. 14/709,618, dated Feb. 4, 2016.

USPTO's Non-Final Office Action issued in related U.S. Appl. No. 14/709,618, dated Nov. 3, 2016.

* cited by examiner

1. Spot (SP) Design–Beam angle (14°),
K–Value (Center Beam/Lumen output)=8.0

2. Narrow Flood (NF) Design–Beam angle (23°),
K–Value=4.9

3. Flood (FL) Design Beam angle (34°),
K-value=2.6

4. Wide Flood (WFL) Design Beam angle (41°),
K-value=1.9

TIR only – Beam angle (16°), K–value = 6.4

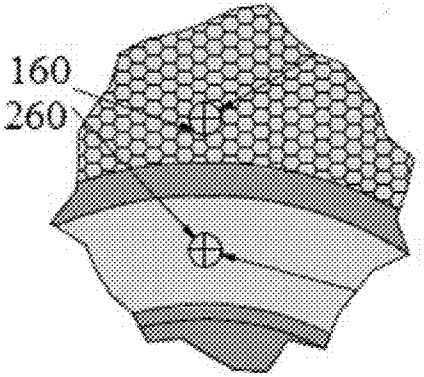
FIG. 11A
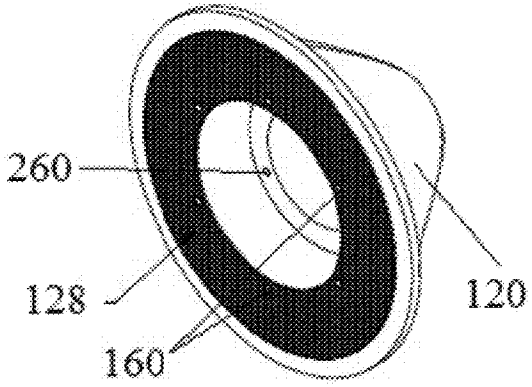
FIG. 11B
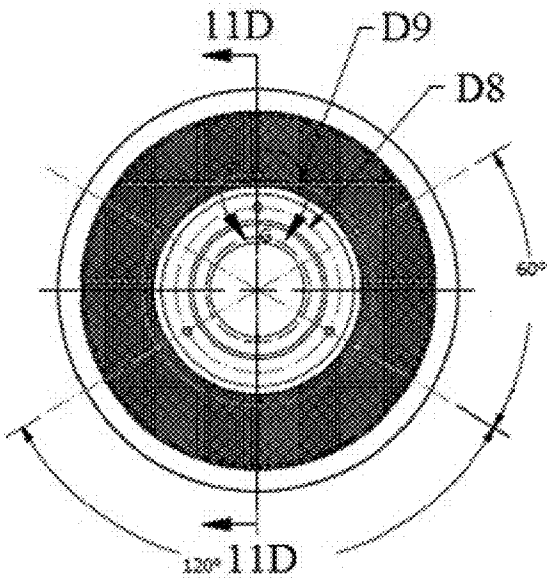
FIG. 11C
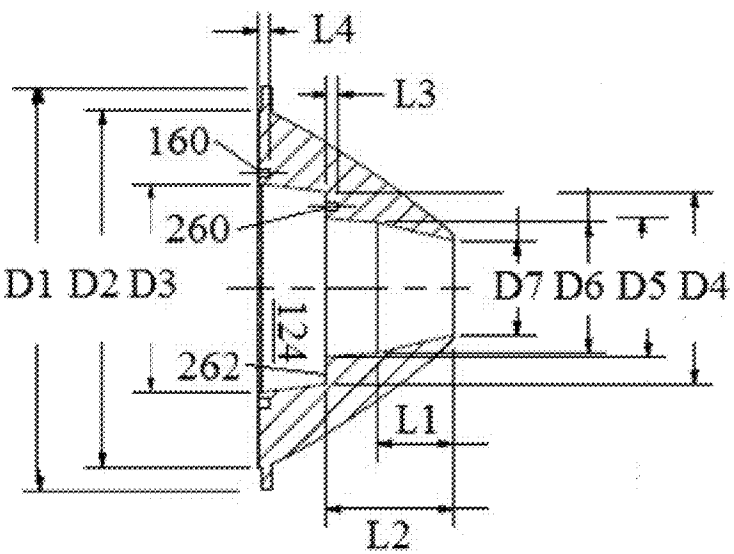
FIG. 11D
FIG. 11

210

210

210
L9
264

D15
D10
D11
D12
D13
D14
224
L6
L7
L5
90°
L8
2°
210

12B
12B
210

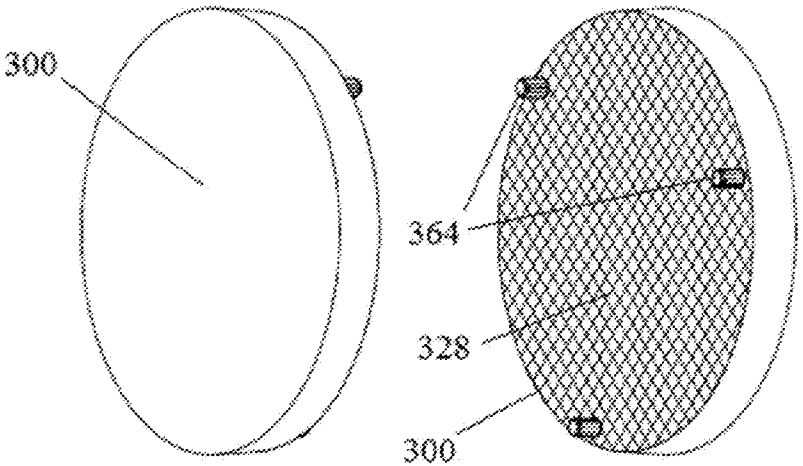
FIG. 13E
FIG. 13D
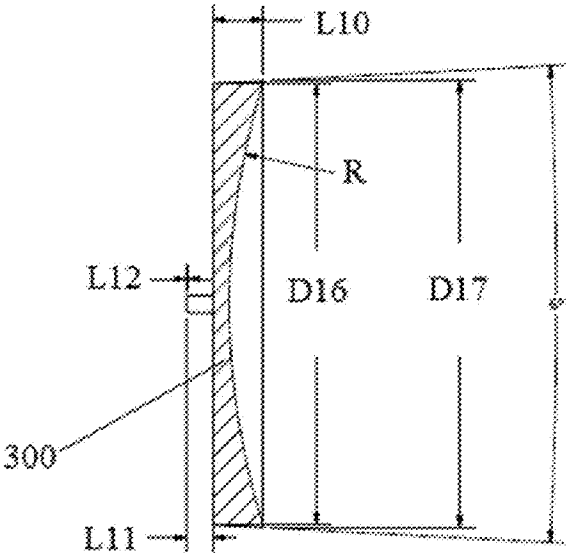
FIG. 13C
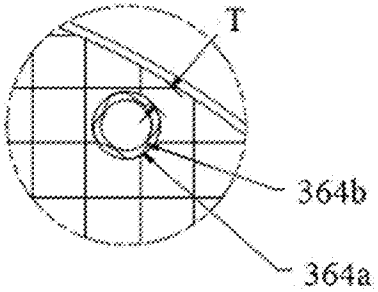
FIG. 13B
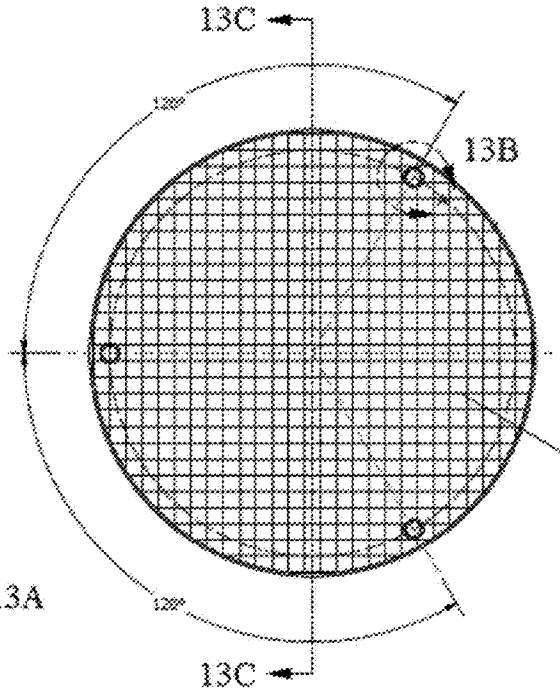
FIG. 13
FIG. 13A

OPTICAL SYSTEM

CROSS-REFERENCE TO RELATED APPLICATIONS

The present patent application is a continuation of and claims the benefit of priority to International Patent Application No. PCT/US15/54332, filed Oct. 6, 2015, which in turn claims the benefit of priority to U.S. Provisional Application Ser. No. 62/137,059, filed Mar. 23, 2015, and U.S. Provisional Application Ser. No. 62/060,448, filed Oct. 6, 2014. The present patent application is also a continuation-in-part of and claims the benefit of priority to U.S. patent application Ser. No. 14/709,618, filed May 12, 2015, which in turn claims the benefit of priority to U.S. Provisional Application Ser. No. 62/137,059, filed Mar. 23, 2015, and U.S. Provisional Application Ser. No. 62/060,448, filed Oct. 6, 2014. Each of the aforementioned patent applications is incorporated by reference herein in its entirety for any purpose whatsoever.

BACKGROUND

In the field of optics, there are various types of lenses which are commonly used independently from one another, each serving a distinct purpose and having a differing function. For example, total internal reflection ("TIR") lenses are often used for illumination or display by light emitting diodes ("LEDs") in light fixtures. Total internal reflection occurs when a light wave strikes the interface between two media that have different refractive indices at an angle that is so great that light cannot pass through the interface but is entirely reflected. TIR lenses can be conical in shape and provide rotational symmetry which provides desired intensity of light at different angles. A Fresnel lens is often used in focusing and imaging applications. It has a large aperture and short focal length, and is made up of a set of concentric, micro-grooved sections which provide collimated light rays which preferably do not diverge in distance. A micro lens is a negative-focal-length micro-structured flat lens. It is mainly used for widening a collimated beam while preserving or improving on the beam uniformity. It has been widely used in linear general lighting. These types of lenses serve vastly different functions and thus have not previously been combined into a single optical system for use in conjunction with one another.

SUMMARY

The present disclosure provides an optical system including a TIR mother lens and a secondary output lens, preferably for efficiently distributing light out of an LED track lighting system. The optical system of the present disclosure is configured to create variant beam angles from a lens assembly using the same TIR lens. Preferably, by altering the dimensions and focal lengths of the secondary output lens in a single TIR lens, the optical system can create a variety of beam angles, including, but not limited to, Spot ("SP"), Narrow Flood ("NFL"), Flood ("FL"), or Wide Flood ("WFL") beam angles. The optical system of the present disclosure provides a conical-shaped TIR lens which allows for placement of a light source at the entrance of the lens, and a secondary Fresnel lens or micro lens placed within the output surface area of the TIR lens, and spaced parallel to, but a distance apart from, the light source. The secondary Fresnel lens or micro lens is preferably set a distance apart from the light source by placing the secondary lens at one end of a hollow cut-out from the TIR lens which is preferably filled with air, with the light source placed at the other end of the cut-out. Preferably, the secondary lens can be interchangeable within the single TIR lens.

Both the TIR and secondary lenses are preferably made of generic poly(methyl methacrylate) ("PMMA") which is a thermoplastic often used in optics as an alternative to glass (having a refractive index of about 1.4893 to 1.4899), but it will be appreciated that other suitable materials can be used, such as acrylic glass (refractive index of about 1.49 to 1.492), polycarbonate (refractive index of about 1.584 to 1.586), polyethylene terephthalate (PET) (refractive index of about 1.575), crown glass (refractive index of about 1.50-1.54), and Pyrex® glass (refractive index of about 1.47). More generally speaking, both the TIR and secondary lenses are preferably made from a material having a refractive index between about 1.3 and about 2.0 and in any incremental value within this range of about 0.001.

According to various embodiments of the present disclosure, the geometry of a TIR lens and secondary lens combination can be altered based on a number of mutually exclusive variables which can change in any embodiment of the disclosure, either individually or in combination. For example, the input and output aperture in the TIR lens can be altered to vary the overall triangular cross sectional profile of the lens and therefore diverges the beam passing through the TIR lens differently. The conical surface curvature of a TIR lens can be varied to yield a desired intensity distribution and beam spread. The conical surface of a TIR lens acts as a highly reflective reflector surface because of total internal reflection (TIR).

A Fresnel lens is a refractor collimator. Thus, by combining the collimating power of both types of lens, one can achieve even higher center beam intensity with the minimal loss. The diameter and/or focal length of the Fresnel lens can be altered to provide varied beam angles.

Preferably, varying the secondary lens within a single TIR lens can result, for example, in four different beam angles from the optical system of the present disclosure: a) a Spot beam (at an angle of 0-17°, or any angular increment therebetween of 0.1 degrees), b) a Narrow Flood beam (at an angle of 18-25°, or any angular increment therebetween of 0.1 degrees), c) a Flood beam (with an angle of 26-39°, or any angular increment therebetween of 0.1 degrees), and d) a Wide Flood beam angle (with an angle of 40° or greater in any increasing angular increment of 0.1 degrees), respectively. While using the same TIR lens and maintaining the distance between the light source and the secondary lens, the focal length of the secondary lens can be altered to affect the resulting beam angle and the center beam output. This allows the optical system of the present disclosure to be used in a variety of products and for a multitude of applications.

In some embodiments, the disclosure provides an optical system that includes a TIR lens and a secondary lens. The TIR lens has a first end and a second end, and is configured to refract light from a light source near the first end of the TIR lens. The secondary lens is attached proximate the second end of the TIR lens. The secondary lens is configured to redirect the light passing through the secondary lens.

In some implementations, the secondary lens can be coaxially co-located with the TIR lens. The TIR lens can define a central passage therethrough that passes through the second end of the TIR lens to define an opening in the TIR lens. The secondary lens can cover the opening and can be about the same size as the opening, or larger. The secondary lens can be a Fresnel lens or a micro lens, for example. The TIR lens is preferably annularly shaped and can define a patterned surface portion at its distal end for redirecting light passing therethrough.

The secondary lens can define a patterned surface portion thereon for redirecting light passing therethrough. The secondary lens can have a diameter that is between about one percent of the diameter of the TIR lens, and 100 percent the diameter of the TIR lens, and in any desired increment therebetween of 1 percent. If desired, the ratio of the radius Ri of the secondary lens to that of the TIR lens at the second end of the system can be between about 0.01 to about 1.0, for example. The ratio of the height of the TIR lens to the radius of the TIR lens can be between about 0.1 to about 10.0, for example.

If desired, the secondary lens can be removably attached to the TIR lens. For example, the secondary lens can be attached to the TIR lens via an interference fit, snap fit, threaded connection, threaded or other fastener, adhesive, and the like. For example, a protrusion on one or more of the secondary lens and TIR lens can be received in a corresponding cavity of one of the TIR lens and secondary lens to couple the secondary lens to the TIR lens.

In further accordance with the disclosure, a light fixture is provided that includes a housing, a light source (such as a LED or group of LEDs) and a TIR lens. The TIR lens can be located within the housing, and can be configured to refract light from the coaxially located light source. The TIR lens can define a central well. The TIR lens can further include a secondary lens disposed over the central well, located at a distance from the coaxially aligned light source and attached to the TIR lens. The secondary lens is configured to redirect the light from the light source. The light fixture can be provided with any of the features or characteristics disclosed elsewhere herein.

All of the components of the optical system of the present disclosure can be incorporated into a housing for use in a variety of products. A benefit of embodiments of the present disclosure is the ability to obtain a plurality of output beams—preferably selected from the group of SP, NFL, FL, and WFL beams—for output in a single device, allowing a user to alter the uses of embodiments of the present disclosure system by mere variation of the secondary lens. Preferably, the optical system of the present disclosure can be utilized for LED lighting from an LED source.

BRIEF DESCRIPTION OF THE FIGURES

FIG. 1(*b*) is a cross sectional view of the optical system seen in FIG. 1, showing the ray-tracing of the TIR lens and the Fresnel lens;

FIG. 1(*c*) is a side perspective view of the optical system seen in FIG. 1, with the Fresnel lens having been removed from the distal end of the central well in the TIR lens;

FIG. 1(*d*) is a top perspective view of the optical system seen in FIG. 1, showing the central well of the TIR lens and placement of the light source at the proximal end thereof;

FIGS. 1(*e*)-1(*g*) are views of a mother TIR lens in combination with a micro lens;

FIG. 2(*b*) is a plotted graph showing the intensity distribution of the Spot beam;

FIG. 3(*b*) is a plotted graph showing the intensity distribution of the Narrow Flood beam;

FIG. 4(*b*) is a plotted graph showing the intensity distribution of the Flood beam;

FIG. 5(*b*) is a plotted graph showing the intensity distribution of the Wide Flood beam;

FIG. 6(*b*) is a plotted graph showing the intensity distribution of the mother TIR lens FIGS. 7(*a*)-7(*e*) illustrate further aspects of the lens assembly of FIG. 2(*a*);

FIGS. 11(*a*)-11(*d*) illustrate a further embodiment of a TIR lens component in accordance with the disclosure having a second set of receiving apertures for a third lens;

FIGS. 13(*a*)-13(*e*) illustrate an embodiment of a third lens that may be inserted into the TIR lens component illustrated in FIGS. 11(*a*)-11(*d*);

DETAILED DESCRIPTION

Figure 1A:
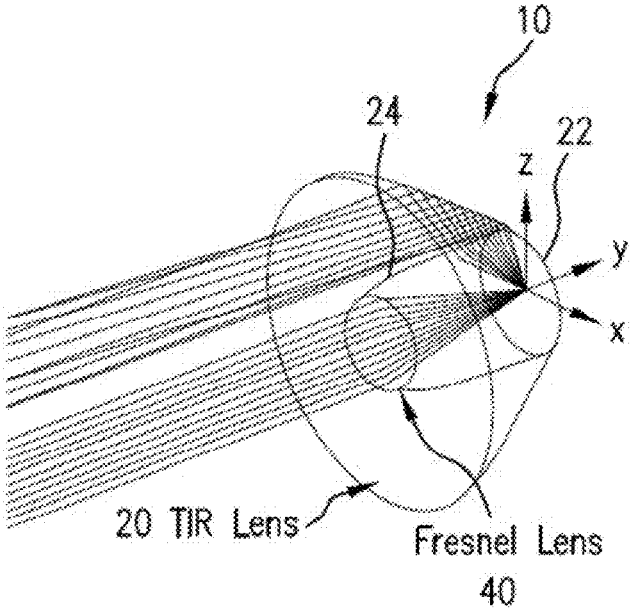
FIG. 1(*a*) is a side perspective view of the optical system of the present disclosure, containing a TIR lens and a circular Fresnel lens placed therein.
Figure 1B:
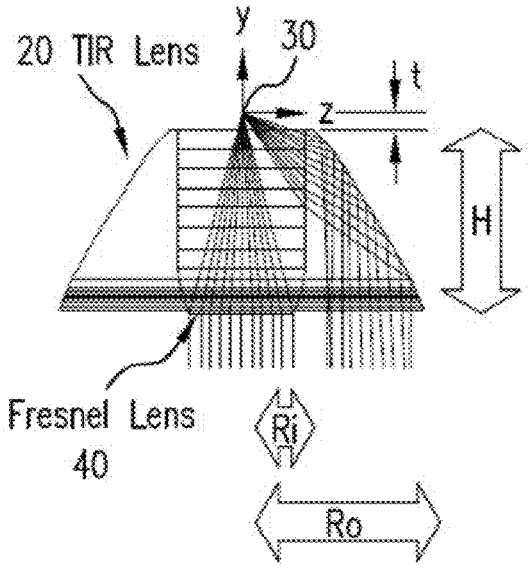
Figure 1C:
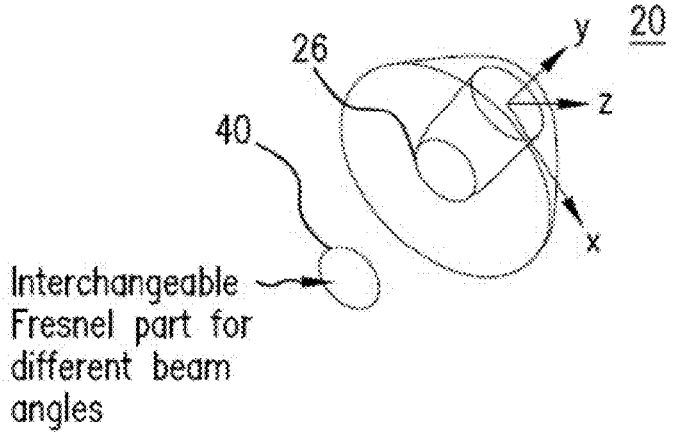
Figure 1D:
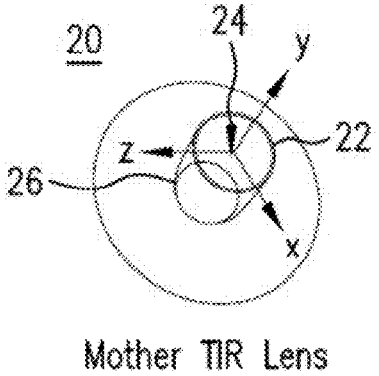

Descriptions herein of the optical systems and lenses of the present disclosure shown in FIGS. 1-15 represent conceptual embodiments of systems embodying the principles of the disclosed embodiments. It should be understood that these figures and embodiments are exemplary in nature and in no way serve to limit the scope of the disclosure.

As can be seen in FIGS. 1(*a*)-(*d*), one illustrated embodiment 10 includes a TIR lens 20 which is preferably conically shaped. At the flat proximal surface 22 of the TIR lens, there is a light source 30, which is preferably an LED light source. Light source 30 is positioned to refract light into the TIR lens which can then provide symmetrical light distribution.

Extending within the TIR lens, and coaxially located with respect to the light source 30 placed at the flat proximal surface 22, is a cut-out segment 24 of the TIR lens, which is more preferably filled with air, through which light can be passed from the light source 30. At the opposite distal end 26 of the cut-out segment 24, and a Fresnel lens 40 can be placed so that it falls within the surface area of TIR lens 20 and spaced a distance apart from the light source 30. Preferably, the Fresnel lens 40 can be interchangeable within a single TIR lens 20. By combining the TIR lens 20 with the Fresnel lens 40, the system can emit a strong central beam. This provides an improvement over the use of a TIR lens individually, which lacks refractive collimating power, and over the use of a Fresnel lens individually, which lacks reflective collimating power.

Figure 1F:
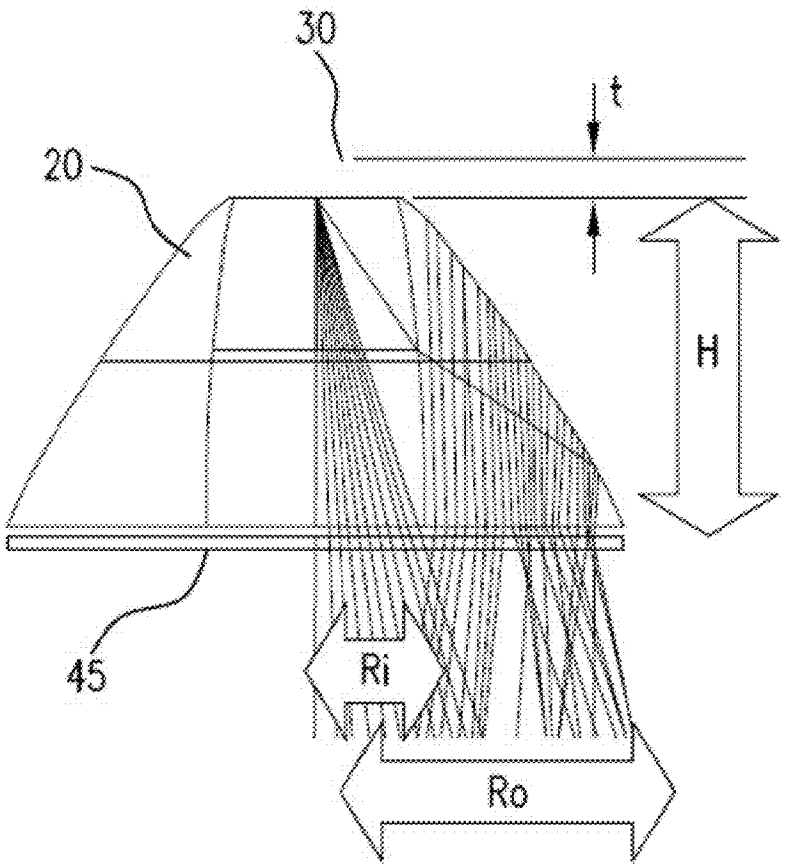
Figure 1E:
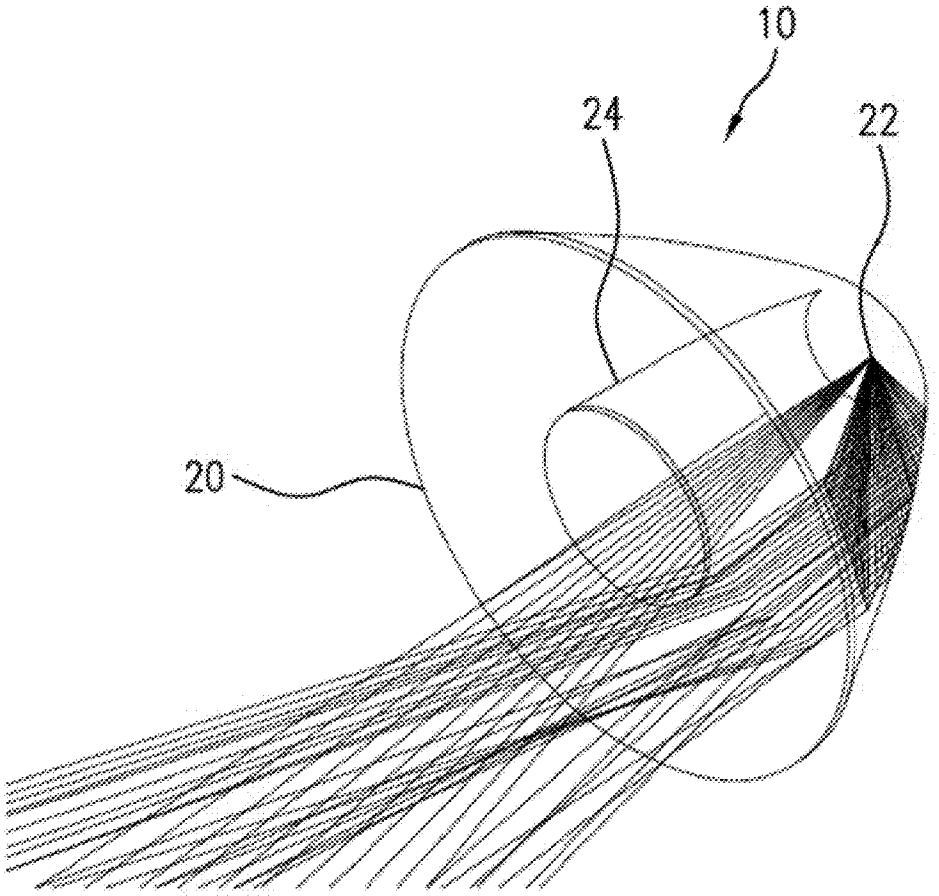
Figure 1G:
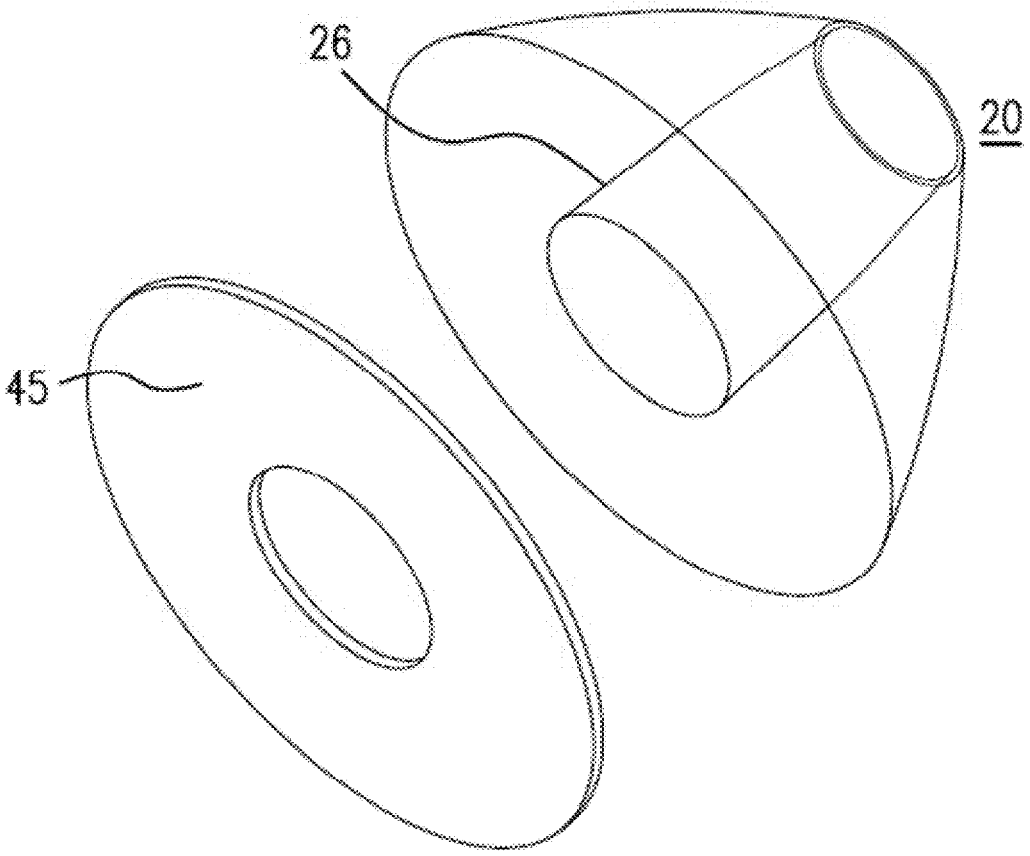

FIGS. 1*e*-1*g* similarly illustrate a system that places a micro lens 45 at the opposite distal end 26 of the cut-out segment 24 rather than a Fresnel lens so that it falls within the surface area of TIR lens 20 and spaced a distance apart from the light source 30. Preferably, the micro lens 45 can be interchangeable within a single TIR lens 20. By combining the TIR lens 20 with the micro lens 45, the light source can emit a desired wider beam.

Examples

The presently provided examples presented below in FIGS. 2-14 are intended to be non-limiting and are presented to illustrate aspects of inventions provided in accordance with the disclosure.

Figure 2A:
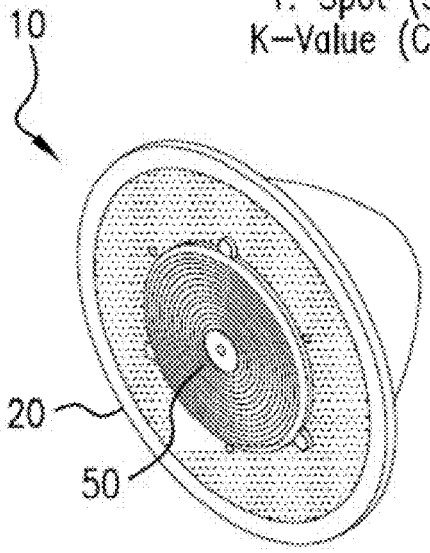
FIG. 2(*a*) is a side perspective view of an illustrative lens system of the disclosure configured to deliver a spot (SP) beam.
Figure 2B:
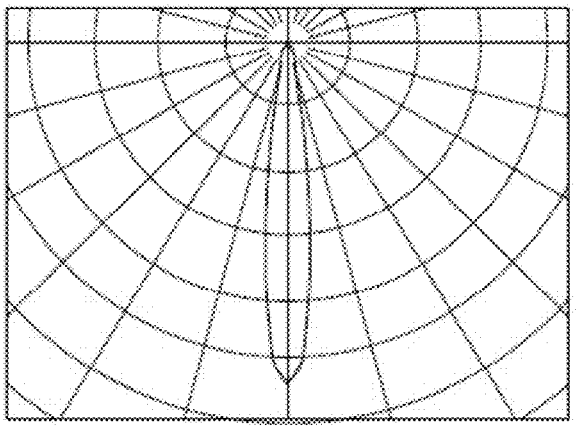

As can be seen in FIGS. 2(*a*)-5(*a*), the optical system 10 preferably provides the additional benefit of enabling a single TIR lens 20 to be used with a variety of secondary (e.g., Fresnel type or other) lenses to create different beam angles of projected light. Preferably, using a single TIR lens 20 and light source 30, at least four different inserted lenses 50, 52, 54, and 56—each with a different diameter, focal length and surface geometries—can be used to create Spot beam (e.g., at an angle of 0-17°, or any angular increment therebetween of 0.1 degrees), a Narrow Flood beam (e.g., at an angle of 18-25°, or any angular increment therebetween of 0.1 degrees), a Flood beam (e.g., with an angle of 26-39°, or any angular increment therebetween of 0.1 degrees), and a Wide Flood beam angle (e.g., with an angle of 40° or greater in any angular increment above 40°), respectively. Of the aforementioned embodiments, the embodiments of FIGS. 2 and 3 use a Fresnel lens insert, while the embodiments of FIGS. 4 and 5 use a micro lens insert, which uses a pattern of (e.g., hexagonal or other shaped) elements to spread out the resulting beam.

A cross sectional side schematic of a secondary micro lens installed over a mother TIR lens is presented in FIG. 1(*f*). The illustrated micro lens insert is a flat lens element that can have micro geometries on one-side or both sides of the lens. Such a lens can be used for spreading out a collimated beam into a wide-distribution beam such as Flood (FL) or Wide Flood (WFL). Its role as opposed to the aforementioned Fresnel secondary lens can be compared to a concave lens vs. a convex lens, where the former spreads out a collimated beam while the latter takes a natural beam at focus and collimate it.

As disclosed herein, the micro-lens insert has micro-lens geometries only on the perimeter that covers the output surface of the mother TIR lens where the collimated beam comes out but leaves the center that covers the air-well of the TIR lens transparent, or with slight surface treatment such as frosting to soften the beam. Therefore, the collimated beam is spread wider by the micro-lens while the direct light from the LED source comes out without collimation to also serve as part of the wider beam.

Plotted graphs showing the intensity distributions emitted through the different lenses 50, 52, 54, and 56 inserted into a mother TIR lens 20 can be seen in FIGS. 2(*b*)-5(*b*), corresponding with the inserted lenses seen in FIGS. 2(*a*)-5(*a*), respectively. This allows the optical system 10 of the present disclosure to be used in a variety of applications and products, while using a single housing 12 (e.g., FIG. 11), the same TIR lens 20, and the same light source 30, despite the need for variation in central beam intensity.

It will be appreciated that the focal length of the secondary lens insert can be any desired distance, to produce beam angle from about 5° to about 150°, in any desired increment there between, for example, of one degree. Moreover, the ratio of the radius Ri of the secondary lens (e.g., 50) to that of the TIR lens (e.g., 20) at the distal face of the assembly Ro can range, for example, from about 0.01 to about 1.0 and in any desired increment there between of about 0.01. At the same time, the ratio of the height H of the TIR lens to its Radius Ro can vary from about 0.1 to about 10.0 and in any desired increment there between of about 0.1. Moreover, the distance between the LED and the TIR lens entrance 22 can be varied from about 1 mm to about 20 mm and in any desired increment there between of about 0.1 mm.

In some embodiments, spot beams can be used for illuminating an object on a wall, a flood beam can be used for ceiling light, and a wide flood beam can be used to light a hallway. As can be seen in FIG. 1(*c*), a Fresnel lens 40 can be removed from the TIR lens 20 to be replaced with another Fresnel or other lens of varying specifications to create different beam angles. Thus, as can be seen in FIGS. 2(*a*)-5(*a*), lenses 50, 52, 54, and 56 can be interchanged within the same TIR lens 20 for creation of SP, NFL, FL, and WFL beam angles, respectively. It will also be appreciated that the diameter of the secondary lens can be any suitable diameter and may overlap the surface of the mother TIR lens to any desired extent as is needed to effectuate the desired design.

Figure 6B:
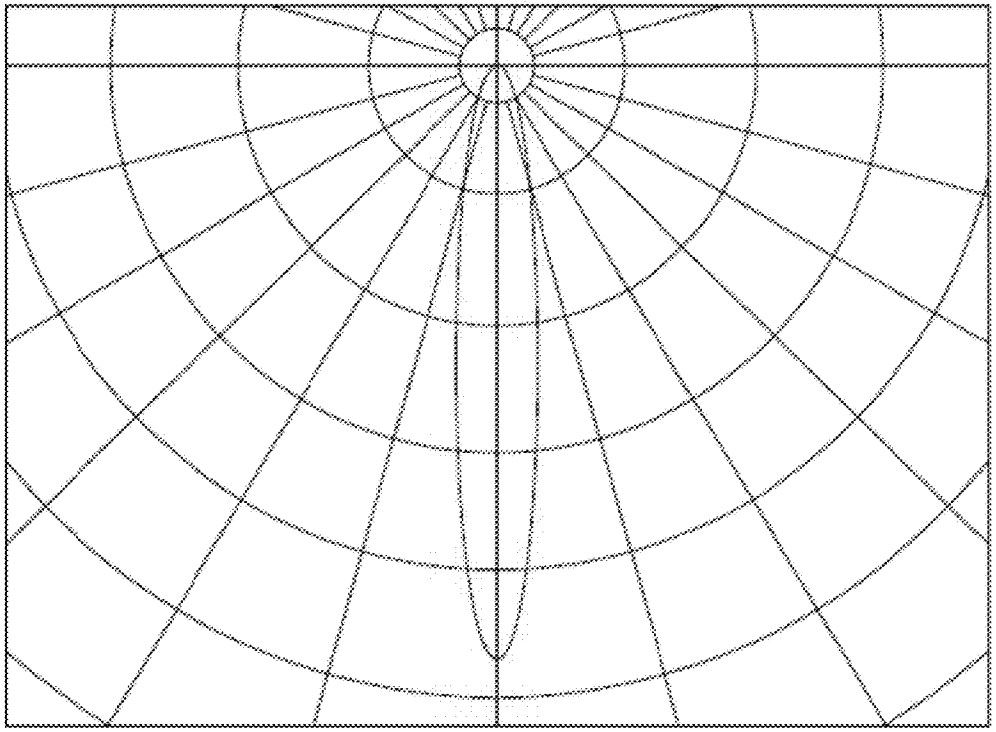
FIG. 6(*a*) is a side perspective view of an exemplary mother TIR lens used in the embodiments of FIGS. 2-5.
Figure 6A:
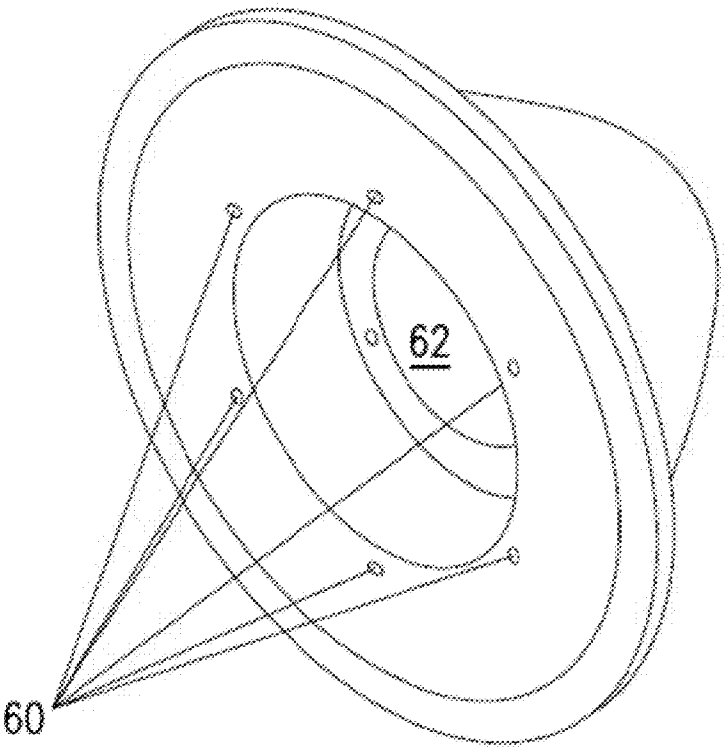
Figure 7A:
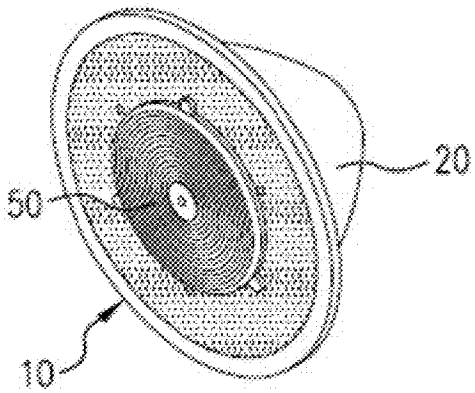
Figure 7B:
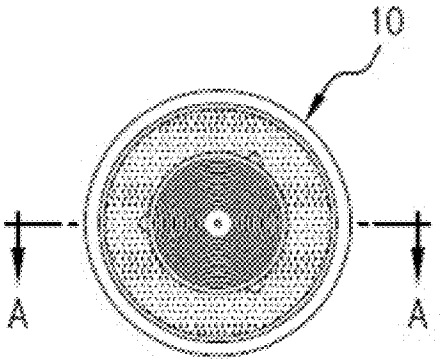
Figure 7D:
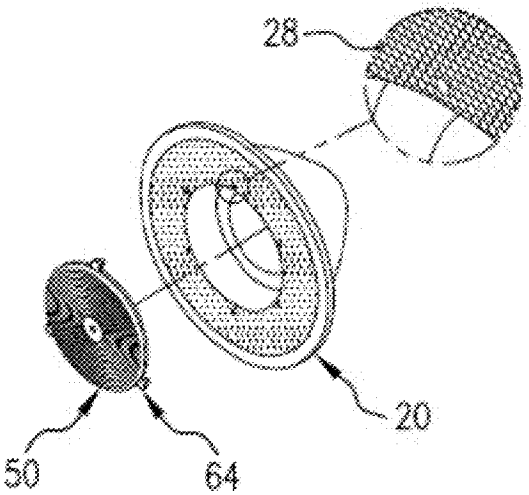
Figure 7E:
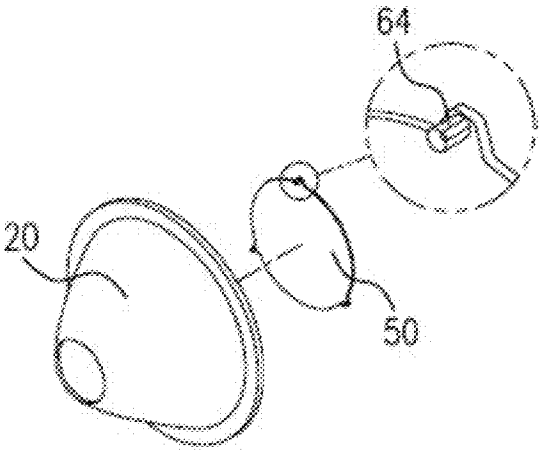
Figure 7C:
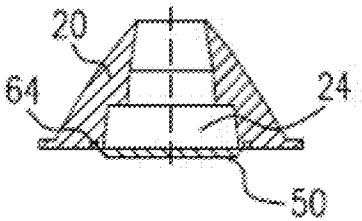
Figure 8A:
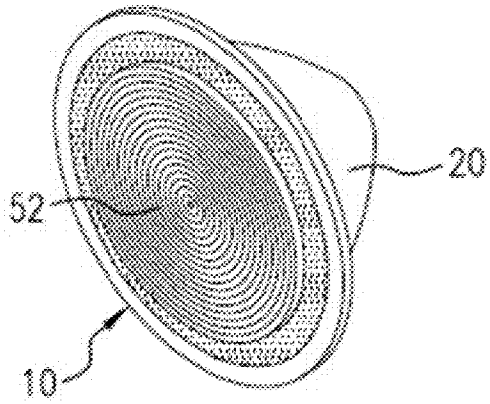
FIGS. 8(*a*)-8(*e*) illustrate further aspects of the lens assembly of FIG. 3(*a*)
Figure 8B:
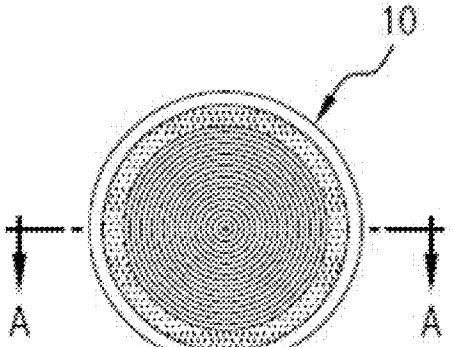
Figure 8D:
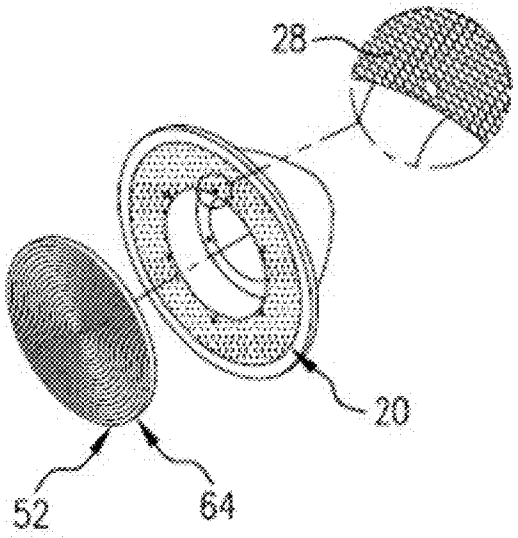
Figure 8C:
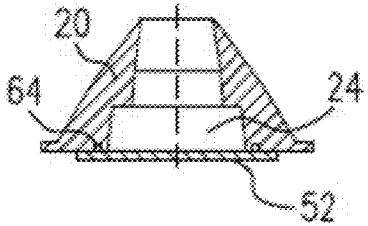
Figure 8E:
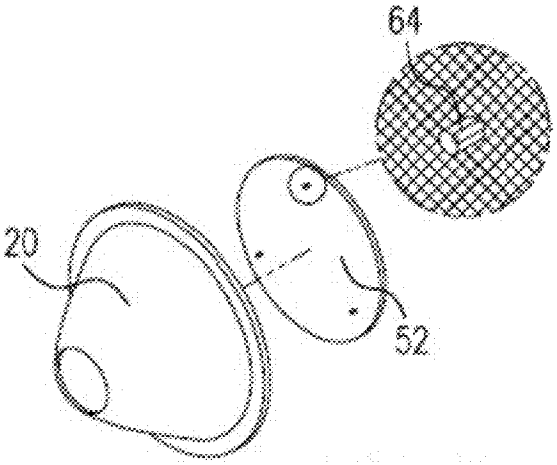
Figure 9A:
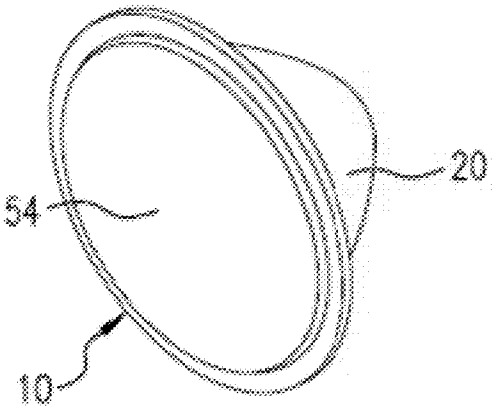
FIGS. 9(*a*)-9(*e*) illustrate further aspects of the lens assembly of FIG. 4(*a*)
Figure 9B:
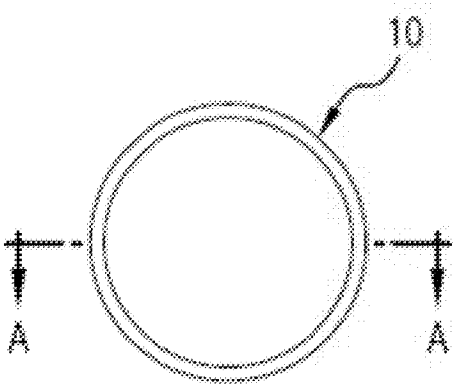
Figure 9D:
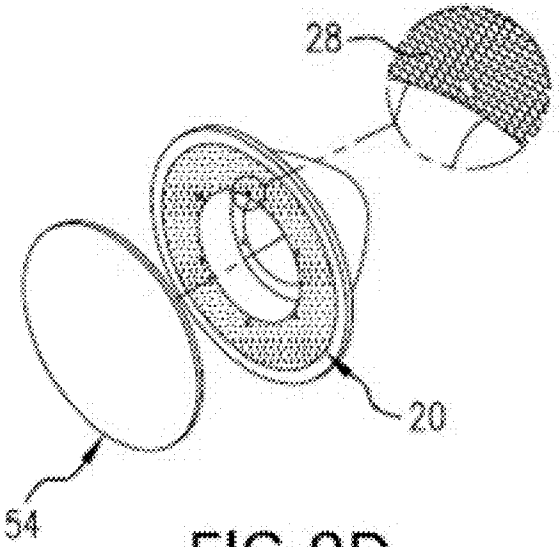
Figure 9C:
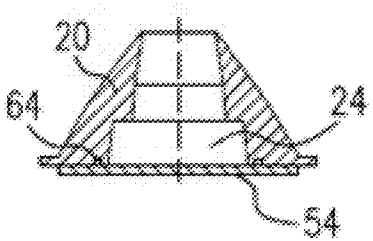
Figure 9E:
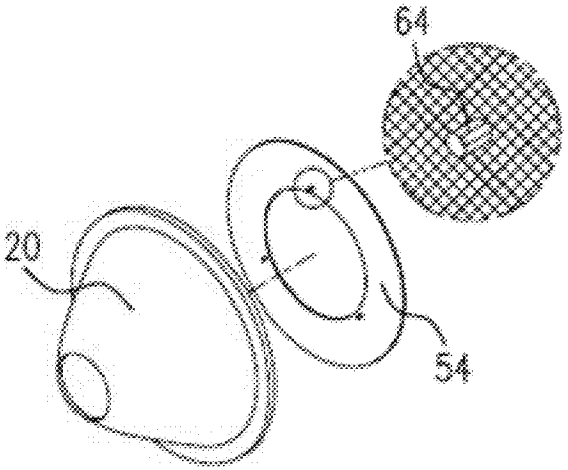
Figure 10A:
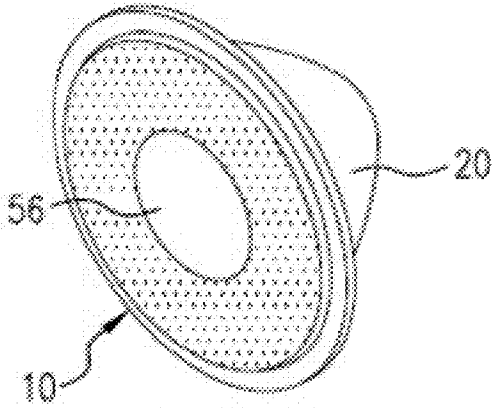
FIGS. 10(*a*)-10(*e*) illustrate further aspects of the lens assembly of FIG. 5(*a*)
Figure 10B:
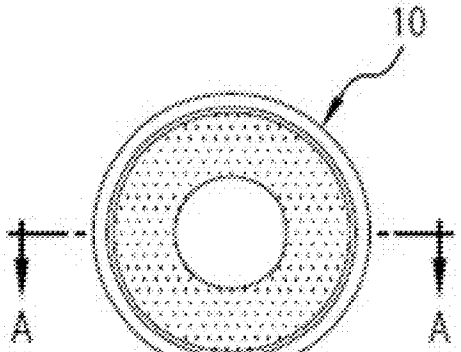
Figure 10D:
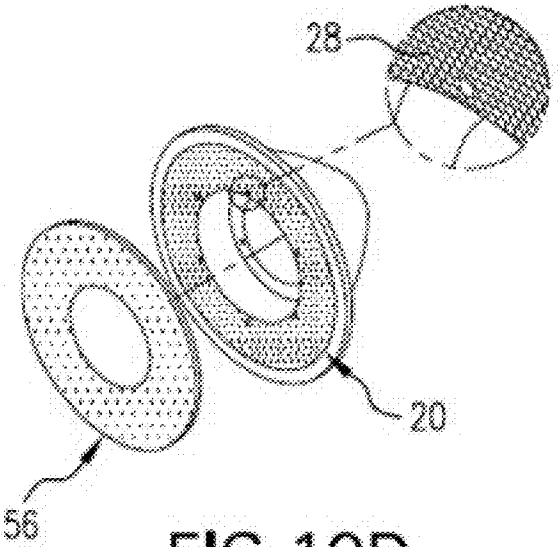
Figure 10E:
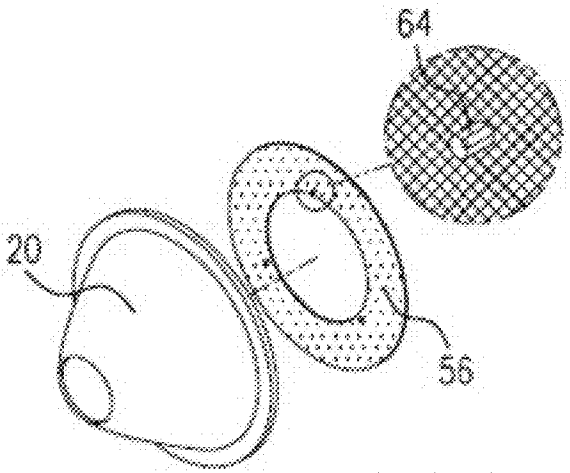
Figure 10C:
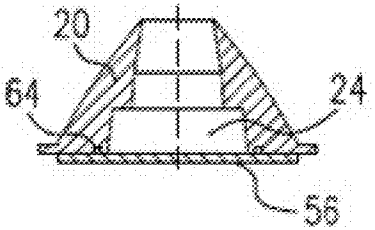

A non-limiting example of an illustrative mother TIR lens and corresponding polar plot are presented in FIGS. 6(*a*)-6(*b*), respectively. As can be seen, six receiving apertures 60 are symmetrically positioned about a central orifice 62 for receiving corresponding alignment and fixation pegs 64 from a corresponding lens insert. As will be appreciated by those of skill in the art, other retaining structures may be used instead of the disclosed peg/orifice combination, such as snap fit connections, threaded connections, adhesive and the like.

FIGS. 7(*a*)-7(*e*) illustrate the lens system illustrated in FIG. 2A in further detail. As can be seen in FIG. 7(*a*), a mother TIR lens 20 is presented with the aforementioned receiving apertures. Also presented is a central Fresnel lens 50 with three symmetrically spaced fixation pegs 64 for insertion into three of the receiving apertures 60. While any method of joining can be accomplished (threaded connection, snap fit, etc.), the illustrated technique can provide for a removable lens insert that can be substituted with other inserts if a user's preference changes or simply to provide versatility. The extra three orifices are provided for substitution if any pegs were broken in the first three orifices when removing a previous insert.

FIG. 7(*b*) presents an end view of the lens assembly 10, whereas FIG. 7(*c*) presents a central longitudinal cross sectional view of the lens assembly 10, illustrating the mother TIR lens 20, and the central Fresnel lens 50 attached to the mother TIR lens 20 via fixation pegs 64. Also present in FIG. 7(*c*) is a stepped central aperture 24 defined through the mother TIR lens 20 including a distal-most chamber adjacent the Fresnel lens 50 that steps radially inward at its proximal end to form a central generally cylindrical chamber that is joined to a conical chamber with a slight taper that terminates at a proximal opening defined into the mother TIR lens 20. FIG. 7(*d*) presents an exploded view of the lens assembly 10, illustrating the mother TIR lens 20, and the Fresnel lens 50, wherein the detail illustrates a prismatic patterning 28 around an annularly shaped distal face of the mother TIR lens. The patterning 28 is for maximizing beam uniformity without sacrificing central beam and beam angle. FIG. 7(*e*) presents a rear facing exploded view of the lens assembly, again illustrating the mother TIR lens 20 and the Fresnel lens 50.

Figure 3A:
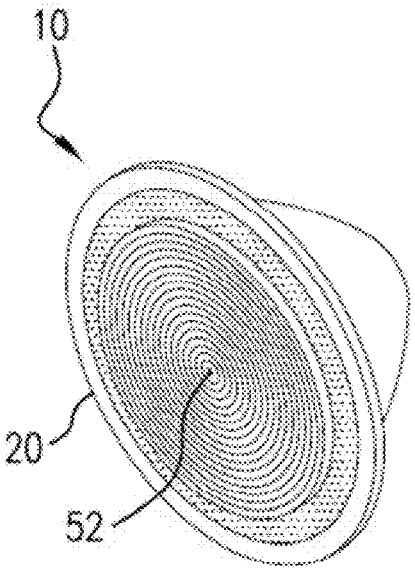
FIG. 3(*a*) is a side perspective view of an illustrative lens system of the disclosure configured to deliver a narrow flood (NF) beam.
Figure 3B:
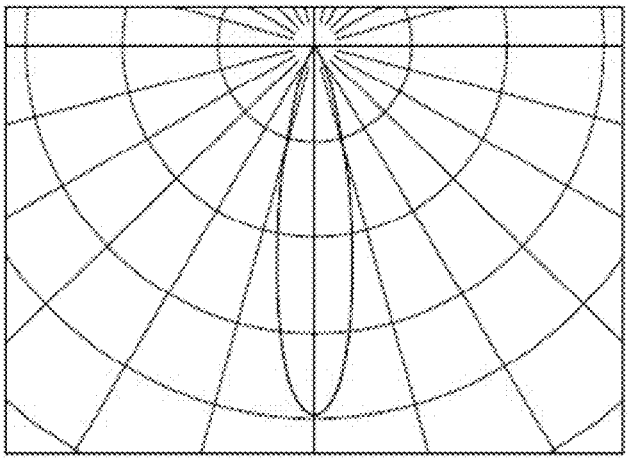

FIGS. 8(*a*)-8(*e*) illustrate the lens system illustrated in FIG. 3A in further detail. As can be seen, a mother TIR lens 20 is presented with the aforementioned receiving apertures. Also presented is a central Fresnel lens 52 with three symmetrically spaced fixation pegs 64 for insertion into three of the receiving apertures. It will be appreciated that the diameter can be any suitable diameter and may overlap the surface of the mother TIR lens to any desired extent as is needed to effectuate the desired design.

FIG. 8(*b*) presents an end view of the lens assembly 10, whereas FIG. 8(*c*) presents a central longitudinal cross sectional view of the lens assembly 10, illustrating the mother TIR lens 20, and the central Fresnel lens 52 attached to the mother TIR lens 20 via fixation pegs 64. Also present in FIG. 8(*c*) is a stepped central aperture 24 defined through the mother TIR lens 20 including a distal-most chamber adjacent the Fresnel lens 52 that steps radially inward at its proximal end to form a central generally cylindrical chamber that is joined to a conical chamber with a slight taper that terminates at a proximal opening defined into the mother TIR lens 20. FIG. 8(*d*) presents an exploded view of the lens assembly 10, illustrating the mother TIR lens 20, and the Fresnel lens 52, wherein the detail illustrates a hexagonal patterning 28 around an annularly shaped distal face of the mother TIR lens. The patterning 28 is for maximizing beam uniformity without sacrificing central beam and beam angle. FIG. 8(*e*) presents a rear facing exploded view of the lens assembly, again illustrating the mother TIR lens 20 and the Fresnel lens 52. As further illustrated in FIG. 8(*e*), lens 52 also includes a patterned portion molded therein in a grid pattern for the best beam uniformity.

Figure 4A:
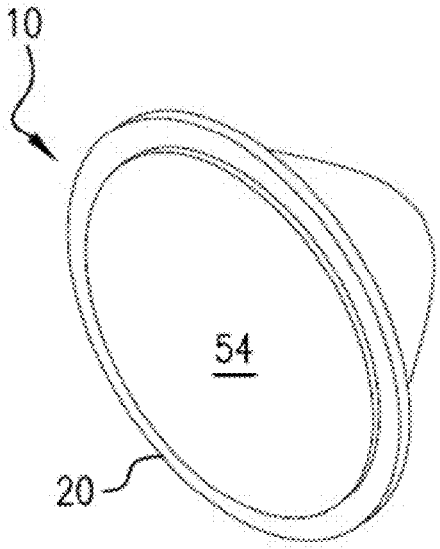
FIG. 4(*a*) is a side perspective view of an illustrative lens system of the disclosure configured to deliver a flood (FL) beam.
Figure 4B:
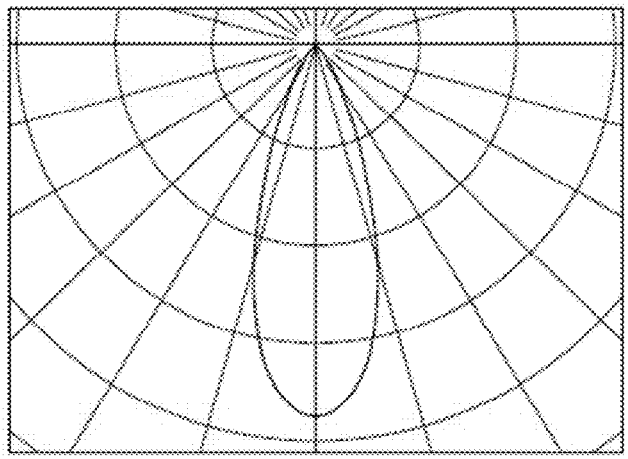

FIGS. 9(*a*)-9(*e*) illustrate the lens system illustrated in FIG. 4(*a*) in further detail. As can be seen, a mother TIR lens 20 is presented with the aforementioned receiving apertures. Also presented is a micro lens 54 with three symmetrically spaced fixation pegs 64 for insertion into three of the receiving apertures, as with the two preceding embodiments.

FIG. 9(*b*) presents an end view of the lens assembly 10, whereas FIG. 9(*c*) presents a central longitudinal cross sectional view of the lens assembly 10, illustrating the mother TIR lens 20, and the central micro lens 54 attached to the mother TIR lens 20 via fixation pegs 64. Also present in FIG. 9(*c*) is a stepped central aperture 24 defined through the mother TIR lens 20 including a distal-most chamber adjacent the micro lens 54 that steps radially inward at its proximal end to form a central generally cylindrical chamber that is joined to a conical chamber with a slight taper that terminates at a proximal opening defined into the mother TIR lens 20. FIG. 9(*d*) presents an exploded view of the lens assembly 10, illustrating the mother TIR lens 20, and the micro lens 54, wherein the detail illustrates a hexagonal prismatic patterning 28 around an annularly shaped distal face of the mother TIR lens 20. The patterning 28 is for maximizing beam uniformity without sacrificing central beam and beam angle. FIG. 9(*e*) presents a rear facing exploded view of the lens assembly, again illustrating the mother TIR lens 20 and the micro lens 54. FIG. 9(*e*) shows the micro lens structure details on lens 54.

Figure 5A:
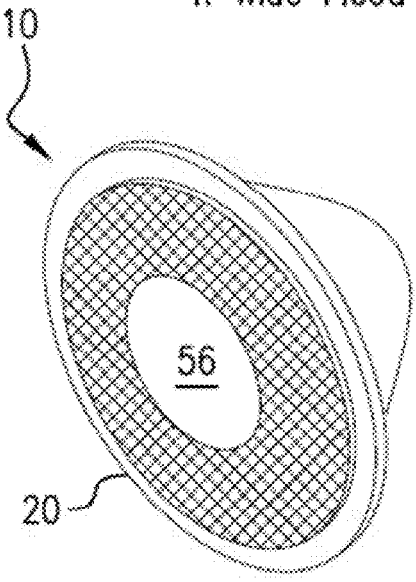
FIG. 5(*a*) is a side perspective view of an illustrative lens system of the disclosure configured to deliver a wide flood (WFL) beam.
Figure 5B:
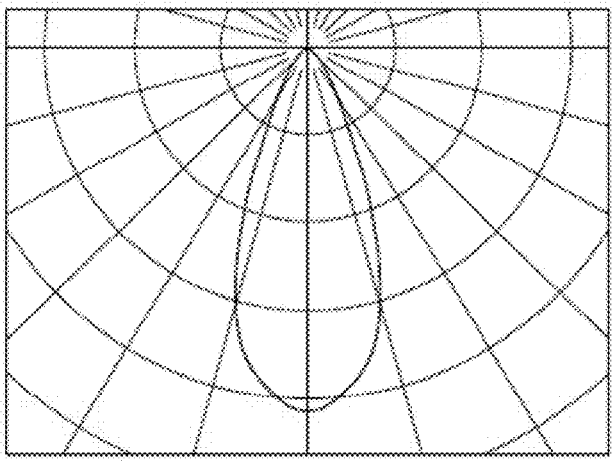

FIGS. 10(*a*)-10(*e*) illustrate the lens system illustrated in FIG. 5(*a*) in further detail. As can be seen, a mother TIR lens 20 is presented with the aforementioned receiving apertures. Also presented is a micro lens 56 with three symmetrically spaced fixation pegs 64 for insertion into three of the receiving apertures, as with the three preceding embodiments.

FIG. 10(*b*) presents an end view of the lens assembly 10, whereas FIG. 10(*c*) presents a central longitudinal cross sectional view of the lens assembly 10, illustrating the mother TIR lens 20, and the central micro lens 56 attached to the mother TIR lens 20 via fixation pegs 64. Also present in FIG. 10(*c*) is a stepped central aperture 24 defined through the mother TIR lens 20 including a distal-most chamber adjacent the micro lens 56 that steps radially inward at its proximal end to form a central generally cylindrical chamber that is joined to a conical chamber with a slight taper that terminates at a proximal opening defined into the mother TIR lens 20. FIG. 10(*d*) presents an exploded view of the lens assembly 10, illustrating the mother TIR lens 20, and the micro lens 56, wherein the detail illustrates a patterning 28 around an annularly shaped distal face of the mother TIR lens 20. The patterning 28 is for maximizing beam uniformity without sacrificing central beam and beam angle. FIG. 10(*e*) presents a rear facing exploded view of the lens assembly, again illustrating the mother TIR lens 20 and the micro lens 56. FIG. 10(*e*) shows the micro lens structure details on lens 56.

FIGS. 11(*a*)-11(*d*) illustrate a further embodiment of a TIR lens component in accordance with the disclosure having a second set of receiving apertures for a third lens.

For purposes of illustration, and not limitation, TIR lens 120 is provided that includes six receiving apertures 160 as in the prior embodiments, but also adds a second row of receiving apertures 260 on circumferential shoulder portion 262. While three apertures 262 are depicted, any desired number can be used.

As can be seen in FIGS. 11C and 11D, proceeding from left to right, lens 120 includes an outer diameter D1 that narrows down diameter D2, where patterning begins on the end of the TIR lens 120. Three, six or any desired number of receiving apertures 160 can be disposed circumferentially about the central axis of lens 120 at diameter D9. The aperture at the second end of the lens is defined by D3. Walls of the central passage taper inwardly to define a conic section until arriving at the outer diameter D4 of shoulder section 262. The inner periphery of annular shoulder 262 is defined by diameter D5, which also defines a second conically shaped chamber that tapers down to diameter D6 over a distance equal to L2–L1. A third conical section is then defined that narrows down to diameter D7 over a length equal to L1. The surfaces of any of the aforementioned conical sections may be concave or convex, as desired, or they may be straight.

Figures 12, 12A, 12B, 12C, 12D, 12E:
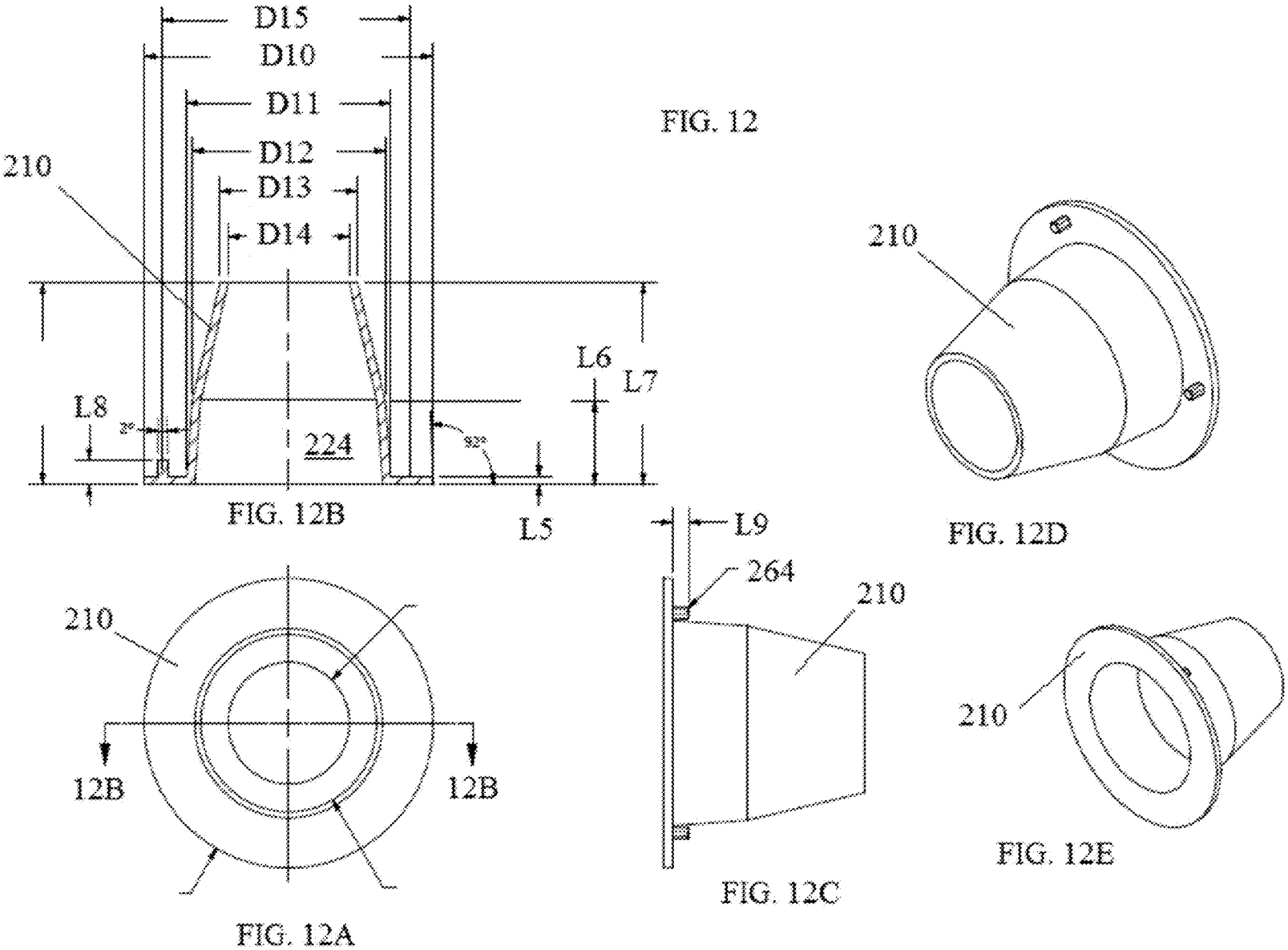
FIGS. 12(*a*)-12(*e*) illustrate an embodiment of an insertable shield that may be inserted into the TIR lens component illustrated in FIGS. 11(*a*)-11(*d*)

FIGS. 12(*a*)-12(*e*) illustrate an embodiment of an insertable shield that may be inserted into the TIR lens component illustrated in FIGS. 11(*a*)-11(*d*).

For purposes of illustration, and not limitation, an optional shield 210 is illustrated having a plurality of bosses 264 that may be inserted into apertures 260. The shield 210 can be used to provide a narrow beam, although at the expense of light output. This can be useful when the angling of the beam (e.g., to illuminate specific items) with a very narrow beam is needed. As illustrated, the shield 210 includes a first end with an annular flange to which the bosses 264 are formed, wherein the annular flange includes an outer diameter D10 and an inner diameter D11. Shield 210 necks down in diameter from diameter D11 to diameter D12 (measured from the outside of shield 210) over a lengthwise dimension L6. The taper then increases over a length L7–L6 until reaching the other end of flange 210 having an outer diameter D13 and an inner diameter D14. As illustrated, shield 210 is not perfectly symmetrical about its central axis, and is slightly eccentric (by about 2.0 degrees) to help create an interference fit when inserted into mother TIR lens 120. The shield is preferably black in color and opaque. Shield 210 can be made from polycarbonate that is heat resistant, or any other suitable material. Mother TIR lens 120 is preferably combined with Fresnel secondary lens 50 when using shield 210.

FIGS. 13(*a*)-13(*e*) illustrate an embodiment of a third lens that may be inserted into the TIR lens component illustrated in FIGS. 11(*a*)-11(*d*).

For purposes of illustration, and not limitation, a third lens 300 is provided that, as illustrated, is concave on one side. As illustrated, the concavity of lens 300 has a radius R, and defines a surface that is a section of a spherical surface. Lens 300 includes a plurality of bosses 364 including a plurality of convex wall portions 364*a* connected by a plurality of concave wall portions 364*b*. Bosses 364 are located radially inwardly a distance T from the periphery of lens 300, and may have a terminal portion having a thickness L12. As illustrated, lens 300 includes a patterned surface portion on its planar side and may or may not include patterning on its concave side.

Figure 14:
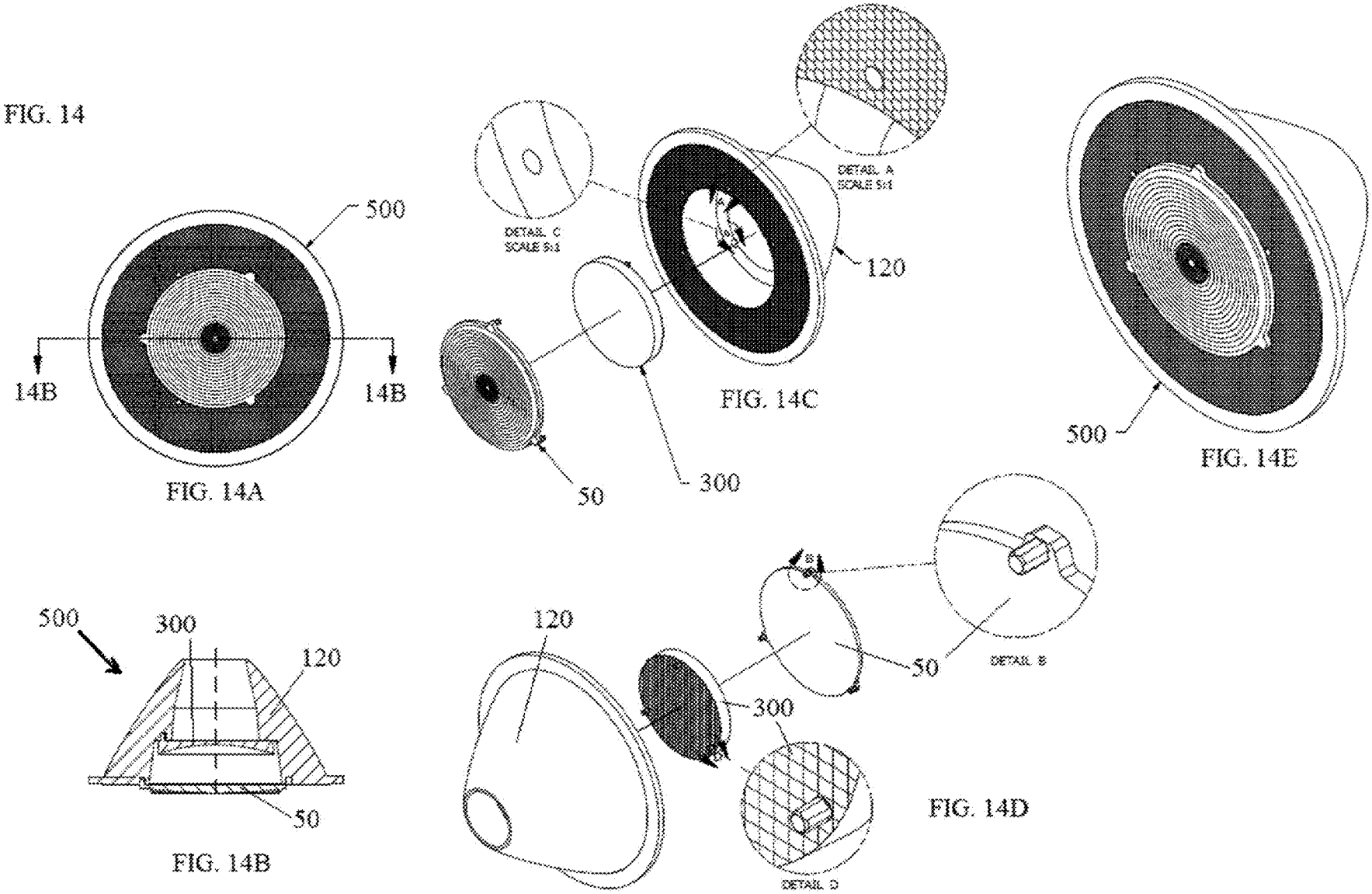
FIGS. 14(*a*)-14(*e*) illustrate an assembly including the TIR lens component of FIGS. 11(*a*)-11(*d*) combined with a Fresnel lens and the third lens illustrated in FIGS. 13(*a*)-13(*e*)

FIGS. 14(*a*)-14(*e*) illustrate an assembly 500 including the TIR lens component 120 of FIGS. 11(*a*)-11(*d*) combined with a Fresnel lens 50 and the third lens 300 illustrated in FIGS. 13(*a*)-13(*e*). As illustrated, the concave surface of lens 300 faces away from shoulder 262 toward the second end of the mother TIR lens 120 (FIG. 14B).

Figure 15:
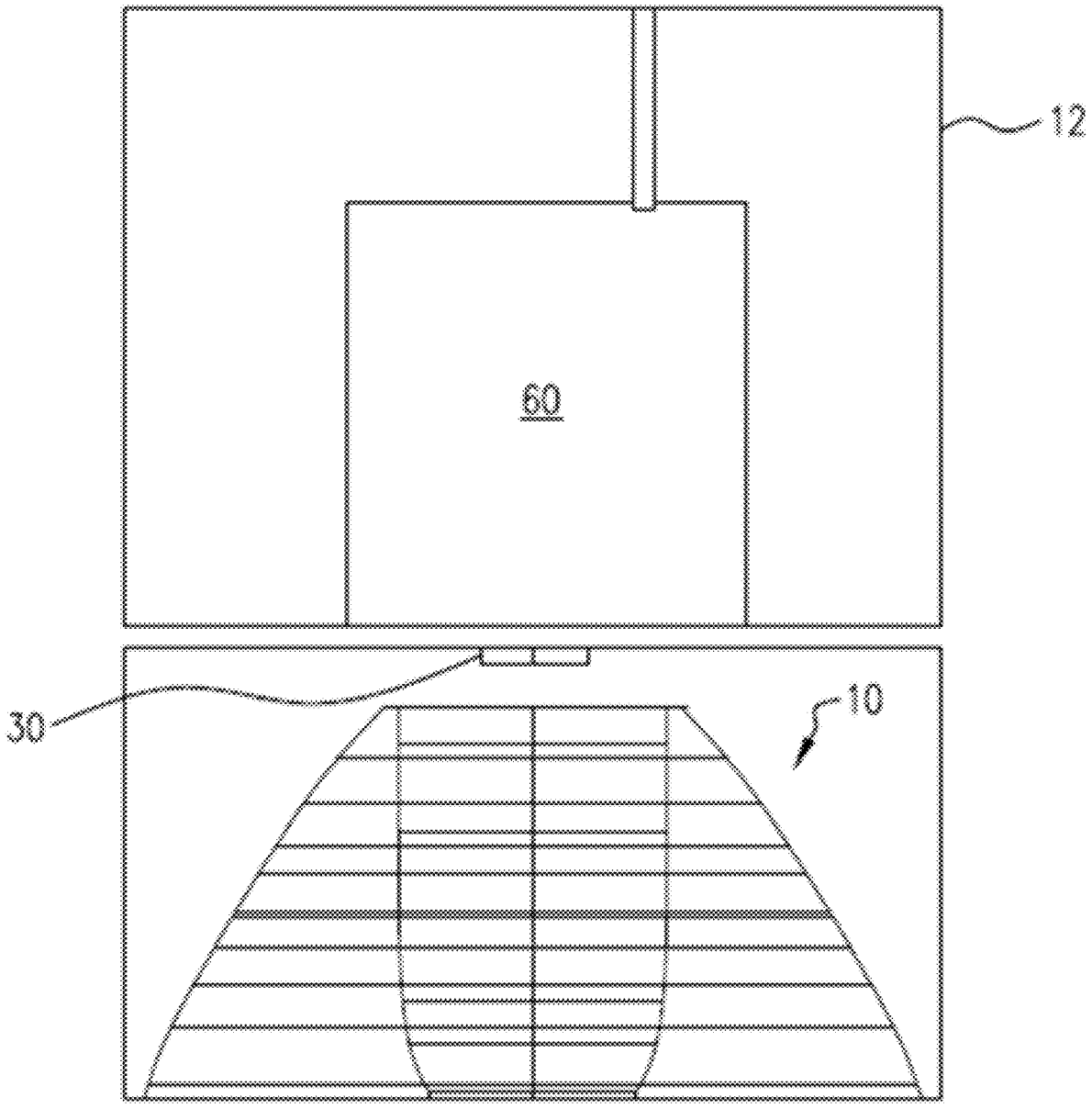
FIG. 15 is a cross section of an exemplary light fixture including an embodiment of the disclosure.
Figure 16A:
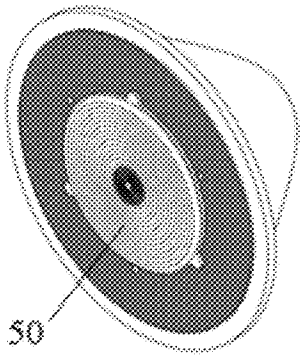
FIGS. 16(*a*)-16(*l*) illustrate beam patterns of optical assemblies in accordance with the disclosure, wherein FIGS. 16(*i*) and 16(*l*) illustrate a mother TIR lens, a secondary lens and an interior third lens and its beam pattern, respectively.
Figure 16D:
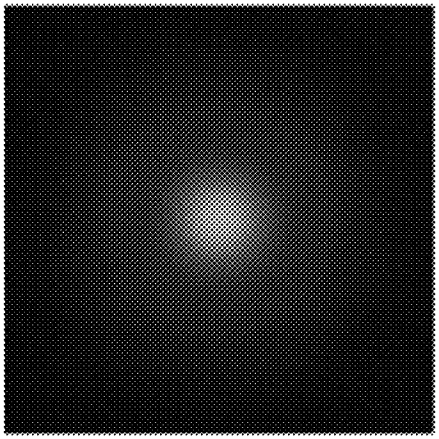
Figure 16B:
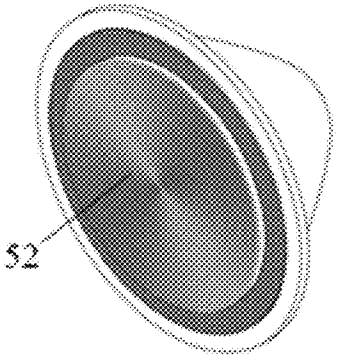
Figure 16E:
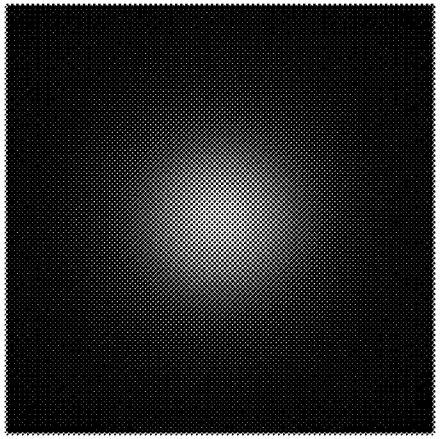
Figure 16C:
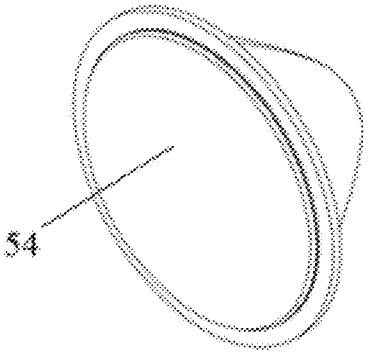
Figure 16F:
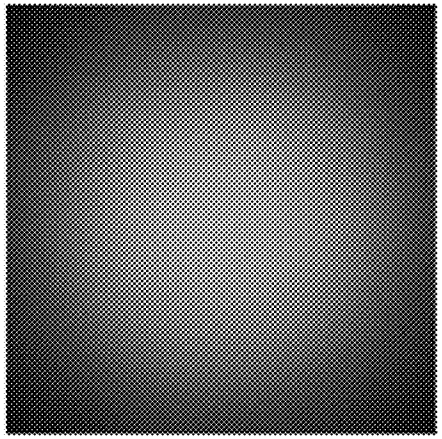
Figure 16I:
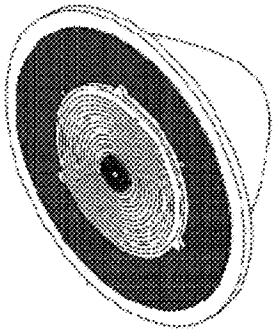
Figure 16L:
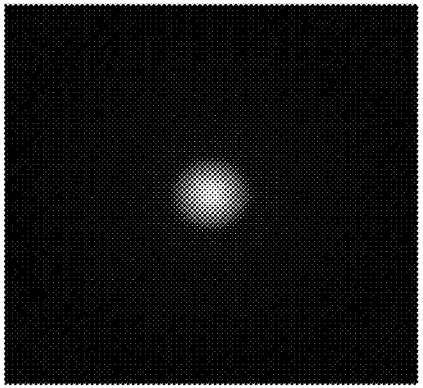
Figure 16H:
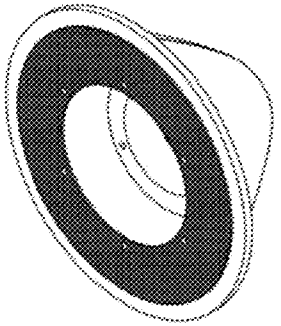
Figure 16K:
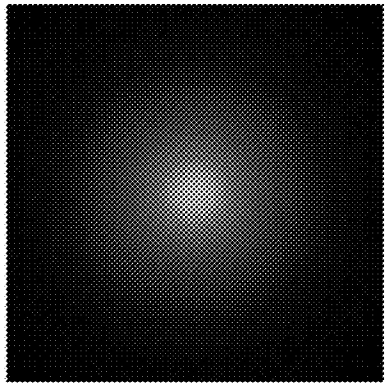
Figure 16G:
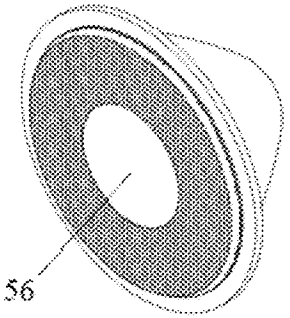
Figure 16J:
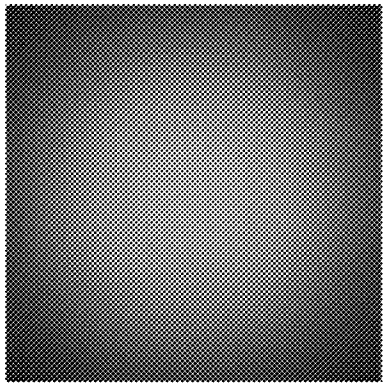

FIG. 15 presents a cross section of an example of a light fixture 100 including a lens element 10 as described herein, operably positioned with respect to one or more LED elements 30, which in turn are operably coupled to a LED driver and/or power supply 60.

FIGS. 16(*a*)-(*c*), and 16(*g*) illustrate assemblies including mother TIR lens in combination with a Fresnel secondary lens 50, a narrow flood secondary lens 52, a flood secondary lens 54, and a wide flood lens 56, respectively. FIG. 16(*h*) illustrates the TIR lens without a secondary lens, and FIG. 16(*i*) illustrates the TIR lens with a Fresnel secondary lens and a third interior concave lens, as illustrated in FIG. 14. FIGS. 16(*d*)-(*f*), and 16(*j*)-(*l*) depict their respective simulated beam plots, showing a progressively more dispersed beam pattern for the four secondary lenses 50, 52, 54, 56.

Figure 17A:
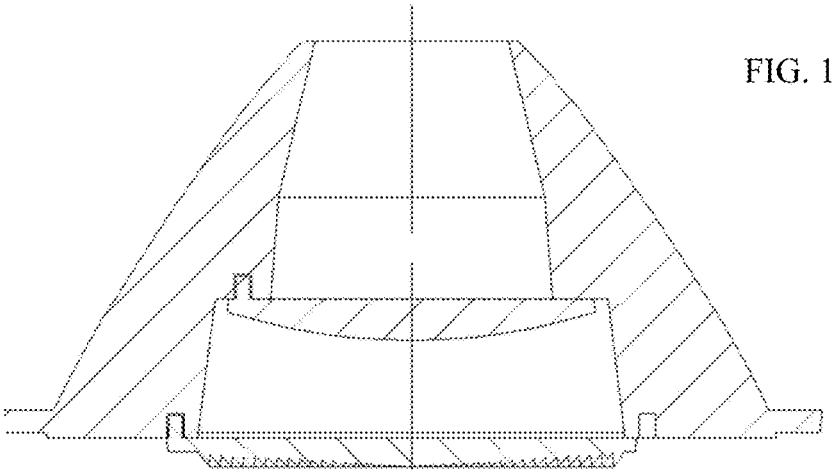
FIGS. 17(*a*)-(*c*) depict optical systems with varying lens combinations.
Figure 17B:
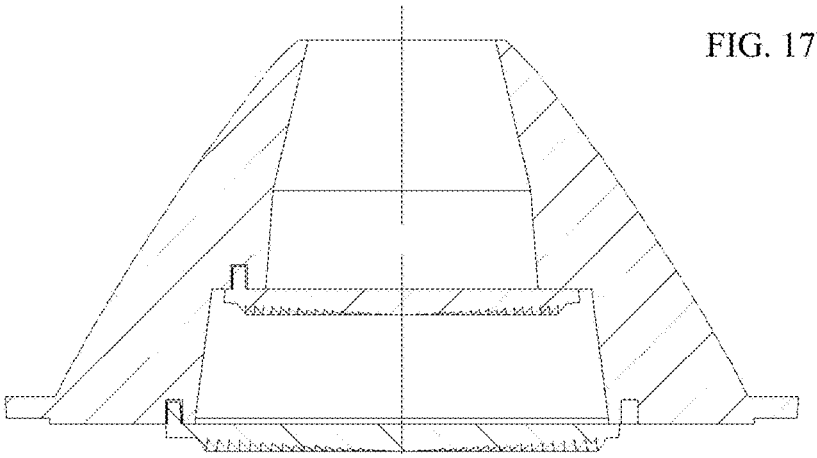
Figure 17C:
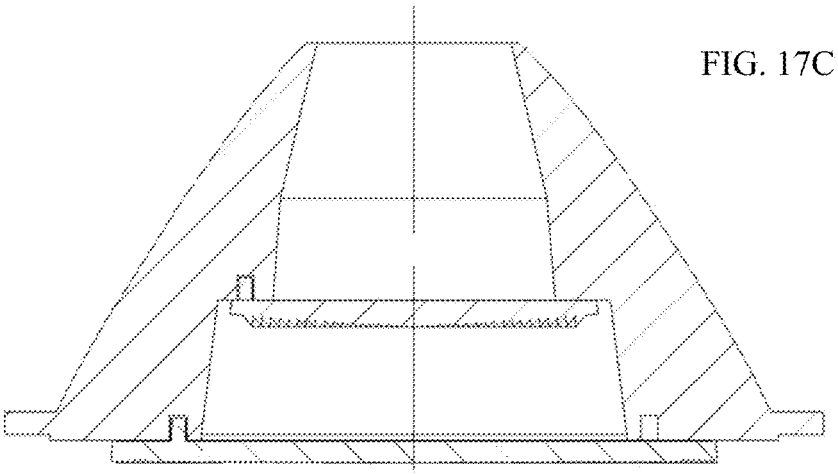

FIG. 17(*a*) depicts an optical assembly including a mother TIR lens including a convex third lens and a Fresnel secondary lens, wherein the concave portion of the third lens faces toward the second end of the mother TIR lens. FIG. 17(*b*) depicts a mother TIR lens including a Fresnel third lens and a Fresnel secondary lens, wherein the patterned surfaces of the Fresnel lenses face toward the second end of the mother TIR lens. FIG. 17(*c*) depicts a mother TIR lens including a Fresnel third lens and a Fresnel secondary lens different from that depicted in FIG. 17(*b*), wherein the patterned surfaces of the Fresnel lenses similarly face toward the second end of the mother TIR lens.

Although the present disclosure herein has been described with reference to particular preferred embodiments thereof, it is to be understood that these embodiments are merely illustrative of the principles and applications of the disclosure. Therefore, modifications may be made to these embodiments and other arrangements may be devised without departing from the spirit and scope of the disclosure.

What is claimed is:

1. An optical system, comprising:

a TIR lens having a first end having a first diameter, a second end having a second diameter larger than the first diameter, an outer tapering peripheral wall connecting the first end and the second end, and an inner peripheral wall defining a cavity through a central region of the TIR lens from the first end to the second end and defining a first opening in the first end of the TIR lens and a second opening in the second end of the TIR lens, the TIR lens being configured to refract light from a light source near the first end of the TIR lens;

a plurality of interchangeable secondary lenses, wherein each of said secondary lenses is configured to be removably disposed at least partially over the second end of the TIR lens and be removably attached to the TIR lens, each of said secondary lenses being configured to redirect the light passing through the secondary lens; and a third lens removably disposed within the cavity of the TIR lens;

wherein the plurality of interchangeable secondary lenses comprises:

a lens configured to result in a beam angle of 0 to 17 degrees;

a lens configured to result in a beam angle of 18 to 25 degrees;

a lens configured to result in a beam angle of 26 to 39 degrees; and a lens configured to result in a beam angle of 40 degrees or greater.

2. The optical system of claim 1, wherein the third lens includes a concave face and a flat, planar face.

3. The optical system of claim 2, wherein the concave face faces toward the second end of the TIR lens.

4. The optical system of claim 1, wherein the secondary lens and third lens are coaxially co-located with the TIR lens.

5. The optical system of claim 1, wherein the secondary lens is a Fresnel lens.

6. The optical system of claim 1, wherein the secondary lens is a micro lens.

7. A light fixture comprising the optical system of claim 1 disposed in a housing, the light fixture further comprising an operable LED light source disposed proximate a central region of the first end of the TIR lens.

8. The optical system of claim 1, wherein the TIR lens is annularly shaped and defines a patterned surface portion at its distal end for redirecting light passing therethrough.

9. The optical system of claim 1, wherein the plurality of secondary lenses each comprises a different diameter, focal length and surface geometry.

10. An optical system, comprising:

a TIR lens having a first end having a first diameter, a second end having a second diameter larger than the first diameter, an outer tapering peripheral wall connecting the first end and the second end, and an inner peripheral wall defining a cavity through a central region of the TIR lens from the first end to the second end and defining a first opening in the first end of the TIR lens and a second opening in the second end of the TIR lens, the TIR lens being configured to refract light from a light source near the first end of the TIR lens;

a plurality of interchangeable secondary lenses, wherein each of said secondary lenses is configured to be removably disposed at least partially over the second end of the TIR lens and be removably attached to the TIR lens, each of said secondary lenses being configured to redirect the light passing through the secondary lens; and an insertable opaque shield disposed within the cavity of the TIR lens;

wherein the plurality of interchangeable secondary lenses comprises:

a lens configured to result in a beam angle of 0 to 17 degrees;

a lens configured to result in a beam angle of 18 to 25 degrees;

a lens configured to result in a beam angle of 26 to 39 degrees; and a lens configured to result in a beam angle of 40 degrees or greater.

11. A light fixture comprising the optical system of claim 10 disposed in a housing, the light fixture further comprising an operable LED light source disposed proximate a central region of the first end of the TIR lens.

12. The optical system of claim 10, wherein the TIR lens is annularly shaped and defines a patterned surface portion at its distal end for redirecting light passing therethrough.

13. The optical system of claim 10, wherein the plurality of secondary lenses each comprises a different diameter, focal length and surface geometry.

* * * * *